United States Patent [19]

Agostine

[11] Patent Number: 5,022,515

[45] Date of Patent: Jun. 11, 1991

[54] HAT CONTAINER

[76] Inventor: Anthony Agostine, Rte. 2, Box 39, Seymour, Wis. 54165

[21] Appl. No.: 432,172

[22] Filed: Nov. 6, 1989

[51] Int. Cl.[5] ..... A45C 11/02; B65D 85/18

[52] U.S. Cl. ..... 206/8; 190/13 G

[58] Field of Search ..... 206/8, 9, 278; 229/87 R; 190/13 G

[56] References Cited

U.S. PATENT DOCUMENTS

| | | | |
|---|---|---|---|
| 293,183 | 2/1884 | Luker | 206/8 |
| 870,550 | 11/1907 | Dod | 206/8 |
| 1,577,632 | 3/1926 | Coles | 206/8 |
| 1,582,102 | 4/1926 | Tuten | 206/8 |
| 1,606,811 | 11/1926 | Schilke | 206/8 |
| 1,777,388 | 10/1930 | Au Werter | 206/8 |
| 1,888,301 | 11/1932 | Waller | 206/278 X |
| 2,049,026 | 7/1936 | Savard | 206/8 |
| 2,343,189 | 2/1944 | Kaufman et al. | 206/8 |
| 2,693,275 | 11/1954 | Smith | 206/8 |
| 2,839,217 | 6/1958 | Trudeau | 206/8 X |
| 3,402,807 | 9/1968 | Hatcher, Jr. | 206/8 |

FOREIGN PATENT DOCUMENTS

| | | | |
|---|---|---|---|
| 807026 | 10/1936 | France | 206/8 |
| 536 | of 1909 | United Kingdom | 206/8 |

*Primary Examiner*—Sue A. Weaver

*Attorney, Agent, or Firm*—Thomas D. Wilhelm

[57] ABSTRACT

A hat storage container wherein outer walls define a body and a bill, enclosing a space comprising a main body chamber and a bill-shaped chamber adapted to receiving a hat bill. The main body chamber is adapted to receive the main body portions of one or more corresponding billed hats. Preferably, the main body chamber is longer than the main body portions of the hats to be stored therein, whereby the main body chamber is adapted to receive a shingled array of a plurality of the hats; and the bill-receiving chamber is adapted to receive the corresponding shingled array of bills.

14 Claims, 2 Drawing Sheets

HAT CONTAINER

BACKGROUND OF THE INVENTION

This invention relates to containers for holding, storing, and transporting hats. It relates most specifically to hats which are commonly referred to as baseball caps. The baseball cap has a domed body portion which conforms generally to the shape of a person's head, in combination with a forwardly extending bill.

It is known to hold, contain, and store hats in containers. Illustrative of such containers are the following United States Patents.

U.S. Pat. No. 2,693,275 Smith shows a cap box for storing a single military style hat having a rigid bill.

U.S. Pat. No. 2,839,217 Trudeau shows a container for storing a pair of military hats wherein each hat comprises a bill.

Neither of the above 2 patents show a hat which conforms generally to the shape of a head nor a hat which can be formed in a shingled array such as can a baseball cap.

U.S. Pat. No. 3,402,807 Hatcher Jr. teaches a hat box and a corresponding hat support for stacking a plurality of derby style hats which have a brim extending completely about the circumference of the main body portion.

While there are a plurality of containers for storing hats, it would be desirable to provide a container capable of storing a plurality of collapsed hats in shingled array, whereby the volume of storage would be minimized.

It would also be desirable to provide such a container which has a decorative appearance and conforms generally to the shape of the hats.

It would further be desirable to provide such a container which both accommodates and restrains the bills of the hats such that the hats are somewhat restrained from free movement within the storage container.

It would still further be desirable to provide a plurality of containers, each of which is adapted to receive a plurality of hats, and which containers are adapted to being removeably attached to each other for vertical storage.

It is an object of this invention to provide a container which has a decorative appearance and conforms generally to the shape of the hats to be contained therein.

It is another object of this invention to provide a container which both accommodates and restrains the bills of the hats such that the hats are somewhat restrained from free movement within the storage container.

It is a further object of this invention to provide a plurality of containers, each of which is adapted to receive a plurality of hats, and which containers are adapted to be removeably attached to each other for vertical storage.

SUMMARY OF THE DISCLOSURE

Some of the objects of the invention are achieved in a hat storage container, for receiving a hat having a main body portion and a bill, the hat storage container comprising outer walls defining a body and a bill, enclosing a space. The enclosed space has a first main body chamber adapted to receive the main body portion of the corresponding hat, and a bill-receiving chamber. The interior of the bill-receiving chamber is cooperatively shaped like the bill on the corresponding hat, and is adapted to receive and confine the bill of the hat.

Other objects of the invention are achieved in a hat storage container, for receiving a plurality of hats, each hat having a main body portion having a length and a width, and a bill. The hats are adapted to nest inside each other, whereby both the main body portions and the bills are arranged in a shingled array. The hat storage container comprises a body and a bill, enclosing a space. The space comprises a main body chamber having a length and a width. The width of the inside of the main body chamber is adapted to receive the widths of the main body portions of the hats. The combination of the length and the width of the main body chamber is adapted to receive a plurality of the hats nested inside each other in a shingled array. The space also comprises a bill-receiving chamber cooperatively shaped like the bills of the hats, and adapted to receive the shingled array of bills corresponding to the shingled array of main body portions of the nested hats, which main body portions are in the main body chamber.

The invention is further defined in a bill shaped container for receiving a plurality of bill hats, the container comprising outer walls defining a body and a bill, and an enclosed space, the enclosed space comprising a main body chamber and a bill-shaped chamber adapted to receive a shingled array of bills of a plurality of hats.

In the preferred embodiments, especially with respect to the containers adapted for receiving a plurality of hats, the length of the main body chamber is longer than a corresponding length of one of the hats.

Preferably each container includes a hanging means adapted to hanging the container such that the bill receiving chamber is pointed in a substantially vertical direction, preferably pointed down. In the most preferred embodiments the container includes a first hanging means on the bill and a second hanging means on the body, opposite the bill. The first and second hanging means are adapted to hanging a first one of the containers from a support using the first hanging means and hanging a second one of the containers from the first container by engaging the first hanging means of the second container with the second hanging means of the first container.

DETAILED DESCRIPTION OF THE ILLUSTRATED EMBODIMENTS

Figure 1:
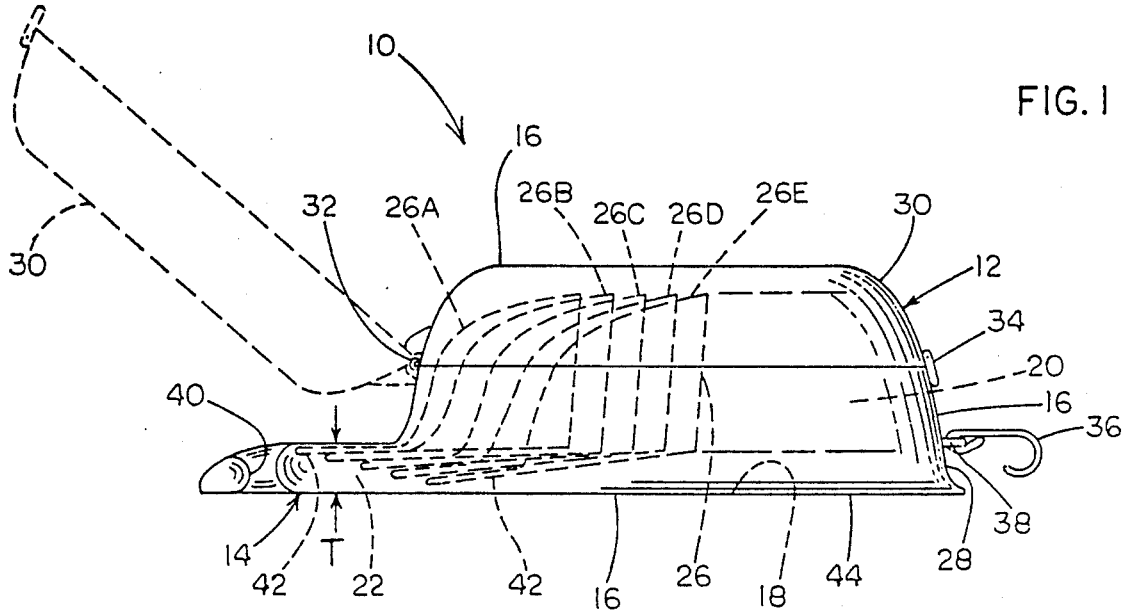
FIG. 1 is a side view of a hat container of this invention, showing in phantom a second (open) position for the hinged lid; and includes in dashed outline a plurality of hats contained in the container.

Referring now to the drawings, the hat storage container generally comprises a main body portion 12 and a bill portion 14. The container generally comprises a plurality of walls 16 which enclose an interior space 18. The interior space 18 generally comprises a main body chamber 20 corresponding to the main body portion 12 of the container and a bill receiving chamber 22 corresponding generally to the bill 14.

Figure 2:
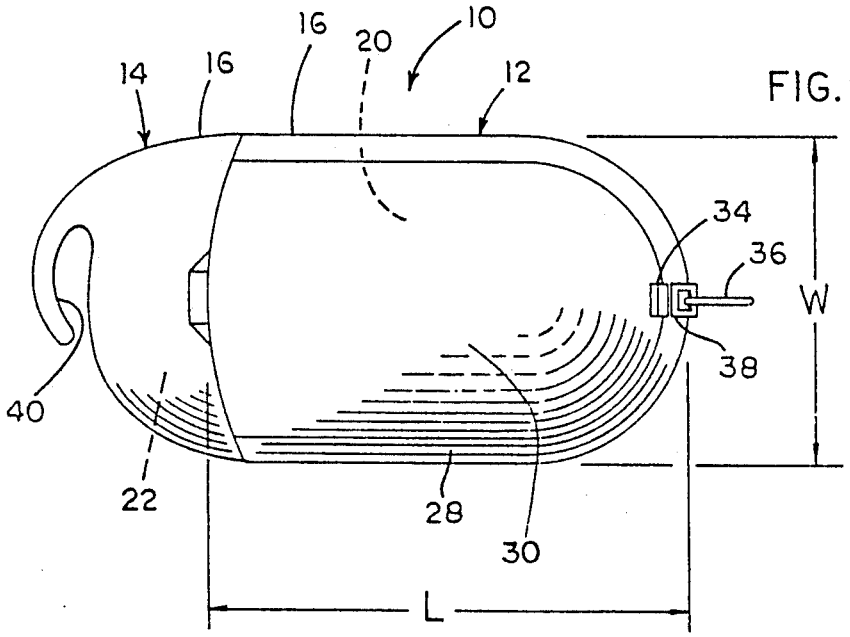
FIG. 2 shows a top view of the container of FIG. 1.
Figure 3:
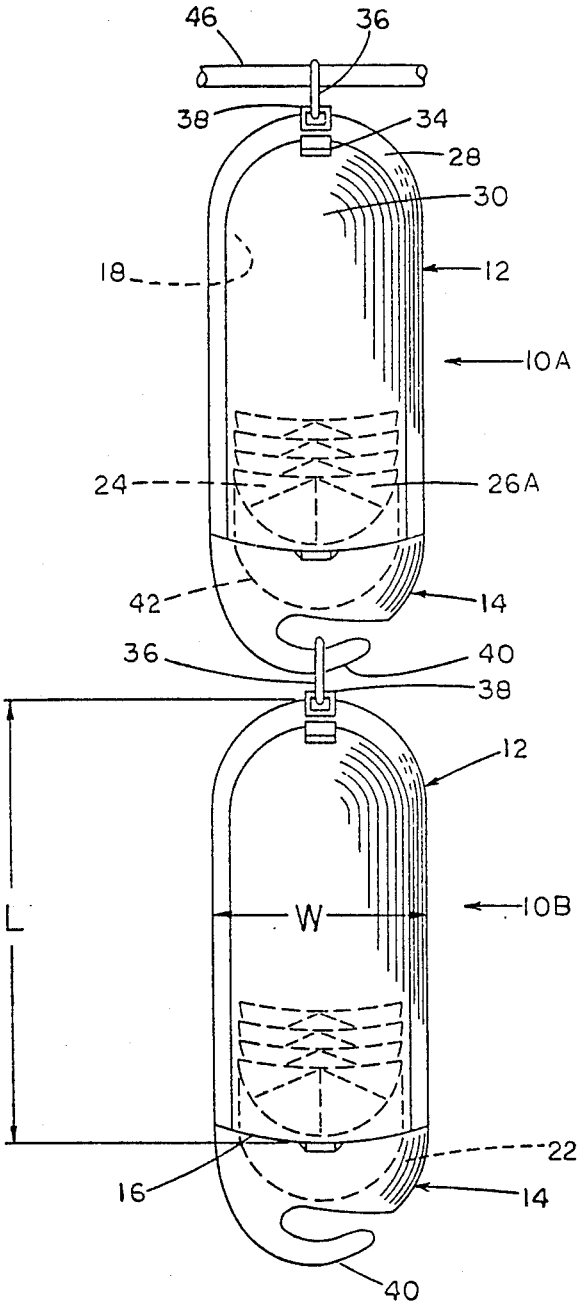
FIG. 3 shows a pair of hat containers of the invention wherein the first container is hung from a rod, and the second container is hung from the first container.
Figure 4:
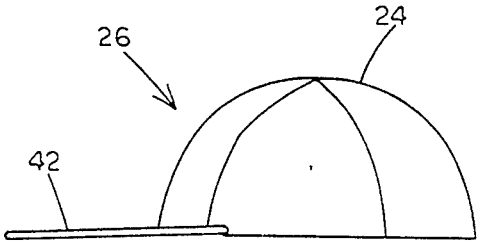
FIG. 4 shows a side view of a typical hat used with the containers of this invention.

The main body chamber has a length generally designated L in FIG. 2 which is sufficiently long to receive the main body 24 of a hat 26 (e.g. as in FIG. 4), and preferably a plurality of hats 26 as seen in FIGS. 1 and 3. As seen in FIG. 4, the main body 24 of the hat illustrated, when set up for use as in FIG. 4, is shaped like a dome, and can be collapsed forwardly whereby it has the shape of a half dome as seen in FIG. 1.

The main body chamber 20 further has a width which is adapted to correspond with receiving the width of the hat, or hats to be placed in it. Referring especially to FIG. 3 it is seen that the main body portion of the hat container, and correspondingly the main body chamber of the hat container, is of sufficient length to receive a plurality of the hats placed therein. The main body chamber is also of sufficient width W to receive and to somewhat restrict the movement in the width direction of the hats. In the elongated embodiments e.g. FIG. 3, and especially as seen in FIG. 3, the length "L" of the main body chamber 20 exceeds the length of the main body portion 24 of the hat 26 by more than the width "W" of the main body chamber 20 exceeds the width of the main body portion 24 of the hat 26.

It is contemplated that the walls 10 of the hat storage containers of this invention are generally thin being of the order of 0.06 to 0.125 inches thick; and generally comprised of a polymeric composition such as a composition based on either a polyethylene or polyvinyl chloride. The material of choice is not limiting, it being exemplary only. The only limiting principle in selecting the material of construction of walls 16 is that they be relatively rigid and sturdy whereby the container will be protective of the hats in normal storage situations.

The container 10 generally comprises two main elements, a lower receptacle 28 and an upper lid 30. Lid 30 is attached to receptacle 28 by hinge 32 and latch 34.

The hat container preferably includes at least one hanger 36 which is seen as a hook attached to the rear of the container by means of a bracket 38.

Preferably the container includes a second hanger 40 on the bill end of the container opposite the rear hanger 36. As illustrated, hanger 40 is molded into, and is a part unitary of, bill 14. If desired, hanger 40 could be replaced by a hook similar to hook 36.

As seen in FIG. 1 the interior space in the container is sized and configured so as to receive a plurality of billed hats. The hats illustrated are baseball caps. As illustrated the baseball caps include the main body portion 24 and the bill 42. As see in FIG. 1 the general appearance of the hat storage container of this invention resembles the appearance of the plurality of caps to be stored therein in that it has an elongated main body portion which generally conforms in transverce to the same section domed shape as the main body portion of the hats and in the elongated longitudinal direction is generally domed to conform to a plurality of such hats in tandem shingled array, and a bill which generally conforms to the shape of the bills of the hats. The space enclosed by the container is generally configured to receive and loosely restrict the movement of a plurality of the hats in shingled array. Preparatory to arranging the hats in a shingled array, substantially the rear half of the rear body portion of the hat is collapsed forwardly into substantially the front body portion of the hat. The collapsed main body portion then has a convex front surface as seen in e.g. FIG. 1, and necessarily a corresponding concave rear surface. Once the hats have been, so prepared the hats can be arranged in a front-to-rear shingled array as seen in FIGS. 1 and 3, whereby the volume identified with storage of a plurality of such hats is sized accordingly. In that arrangement the leading hat receives the convex front surface of the main body portion of the hat behind it within the concavity at the rear surface of its main body portion as indicated in FIG. 1. Correspondingly the bill of the trailing hat is positioned in a trailing shingled array, below and somewhat to the rear of the leading edge of the bill of the leading hat. The arrangement of the bills and the arrangement of the main body portions of the hats are seen in FIG. 1. A pair of centerlines is used in FIG. 1 to indicate that additional caps can be arranged in the shingled array in a manner similar to the five hats shown.

In FIG. 3 four hats are shown from a direction generally viewed from the top of the hat.

With respect to dimensioning of the hat enclosed spaced of the storage container of this invention, it is important that the width W be sufficiently wide to receive the hats as shown in, for example, FIG. 3 and sufficiently narrow to restrict gross movements of the hats whereby the positioning of the hats in a front-to-rear shingled array is maintained. It is further important that the length dimension L be sufficiently long to receive at least one hat and, preferably a plurality of hats as shown in the drawings.

Further to the dimension of the enclosed space, it is important that the length of the bill receiving chamber 22 be sufficiently long to receive the bill of the lead hat, designated in FIGS. 1 and 3 as hat 26A. The thickness T of the interior space in the bill receiving chamber 22 has a sufficient dimension to accommodate the plurality of hat bills which are stacked in the shingled array. As seen in FIG. 1, and especially with respect to hats 26C, 26D, and 26E, the trailing hats are tilted with respect to the bottom 44 of receptacle 28. Thus the thickness T will be determined by the number of bills 42 of the hats 26 which will be received within the bill receiving chamber. As seen in FIG. 1 the bills 42 of hats 26A, 26B and 26C are clearly received within the bill receiving chamber. The bill of hat 26D approaches the bill receiving chamber. The bill of hat 26E does not enter the bill receiving chamber, but is rather restrained by the shingled array of bills that are received within the bill receiving chamber 22.

Accordingly, the thickness T of the bill receiving chamber is important in order to accommodate at least the number of bills which will be received when the hats are placed in shingled array in the container. However, the thickness T should be sufficiently small as to restrict unfettered movement of the bills within the bill receiving chamber. The thickness T of the bill receiving chamber should be large enough to accommodate receiving the bills and be small enough to restrict the movement of the bills such that they are restrained from free movement without restriction. So some modest amount of interference is desired between the bill receiving chamber and the bills adjacent its surfaces. The thickness of the specific bill receiving chamber will thus be determined according to the number of bills which will be received into it in a shingled array of indefinite length, and according to the thickness as of the bills of the individual hats.

The width W of the main body chamber 20 is selected somewhat for convenience and somewhat for function. It must be sufficiently wide to receive the hats as shown in FIG. 3. It must also be sufficiently narrow to restrict the movement of the hats sufficiently that they are not dislodged across the width of the shingled array.

The length L, as a minimum dimension, must be long enough to receive at least one hat. Desirably it is longer whereby it will receive a plurality of hats as shown. As long as the minimum length requirement is satisfied, there is in general no upper limit to the length of the main body chamber. The main body chamber of the hat container illustrated in FIG. 1 will contain for example approximately ten hats and illustrates the preferred embodiment. Accordingly FIG. 2 shows the top view of the same embodiment.

FIG. 3 illustrates an embodiment which will contain approximately 15–20 hats, whereby it is somewhat longer. As seen in the drawings, the containers of FIGS. 1, 2, and 3 correspond in shape to elongated embodiments of the domed hat 26 of FIG. 4.

The purpose of the hat containers of the invention is to provide efficient and clean storage for a plurality of hats.

Referring now to FIG. 1 the hat container of the invention is opened by releasing latch 34 and pivoting lid 30 about hinge 32 as seen in the dashed line illustration. With the lid thus pivoted about hinge 32, the interior space 18 is accessible through the open top of receptacle 28. The hats can be placed in the container as shown in FIG. 1. When the desired number of hats have been placed in the container, the lid 30 can be reclosed and the latch secured.

The hat storage containers of this invention are adapted to be hung from a clothes rod 46 shown in FIG. 3. Rear hanger 36 is hooked over rod 46 whereby the hat container is suspended from the rod with the bills 42 in a vertical disposition, and pointed downwardly. The force of gravity is thus used to maintain the bills 42 in the restrained confinement of bill receiving chamber 22.

A plurality of the hat storage containers of this invention can be hung one under the other as seen in FIG. 3. Accordingly hanger 36 of the lower container 10B is engaged with hanger 40 of the upper hat storage container 10A.

Thus the invention provides a container which has a decorative appearance and conforms generally to the shape of the hats to be contained therein.

The invention further provides a container which both accommodates and restrains the bills of the hats such that the hats are somewhat restrained from free movement within the storage container.

The invention also provides a plurality of containers, each of which is adapted to receive a plurality of hats, and which containers are adapted to be removeably attached to each other for vertical storage.

While the invention has been described above with respect to its preferred embodiments, it will be understood that the invention is capable of numerous rearrangements, modifications, and alterations, and all such arrangements, modifications, and alterations are intended to be within the scope of the appended claims.

Having thus described the invention, what is claimed is:

1. A hat storage container, for receiving a plurality of hats, each hat having a main body portion having a length and a width, and a bill, the hats being adapted to folding a rear segment of the main body portion forwardly into a front segment of the main body portion, thereby collapsing the main body portion, the collapsed main body portion having a convex front surface and a correspondingly concave rear surface, the concave rear surface of a collapsed main body portion of a first forwardly disposed hat being thus adapted to receive the convex front surface of a main body portion of a second rearwardly disposed hat, the leading edge of the bill on the second rearwardly disposed hat being disposed rearwardly of, and below, the leading edge of the bill on the first forwardly disposed hat, whereby the collapsed main body portions of the hats so disposed are arranged front-to-rear, and wherein the bills of the hats are thus arranged in a shingled array, said hat storage container comprising a container body and a container bill, the combination of said container body and said container bill enclosing a space, and comprising:

(a) a main body chamber defined by said container body, said main body chamber having a length and a width, the width of the inside of said main body chamber being dimensioned to receive the widths of the main body portions of the hats, said length of said main body chamber being longer than the length of the main body portion of one of the hats when collapsed, and being dimensioned to receive a plurality of the hats wherein the main body portions of the hats have been collapsed, front to rear, and the convex front surface of a rearwardly disposed hat is received by the concave rear surface of the next forwardly disposed hat, whereby the main body portions of the hats so disposed are arranged front-to-rear, and wherein the bills of the hats are thus arranged in a front-to-rear shingled array; and (b) a bill-receiving chamber cooperatively shaped like the bills of the hats, and dimensioned to receive the front-to-rear shingled array of bills corresponding to the collapsed arrangement of main body portions of the plurality of hats in the main body chamber, wherein the leading edge of the bill on a rearwardly disposed hat is disposed rearwardly of, and below, the leading edge of the bill on the next forwardly disposed hat.

2. A container as in claim 1 wherein the length "L" of said main body chamber exceeds the length of the main body portion of a collapsed corresponding hat which said container is dimensioned to contain, by more than the width "W" of said main body chamber exceeds the width of the corresponding collapsed hat.

3. A container as in claim 2, including a first hanging means on said bill and a second hanging means on said body, opposite said bill, said first and second hanging means being adapted to hang a first one of said containers from a support, using said first hanging means, and to hang a second one of said containers from said first container by engaging said first hanging means of said second container with said second hanging means of said first container.

4. A container as in claim 1 including hanging means as a potion of said container at the rear thereof remote from said bill, thereby to permit hanging of said container with the bill chamber lowermost.

5. A container as in claim 1, including a first hanging means on said bill and a second hanging means on said body, opposite said bill, said first and second hanging means being adapted to hang a first one of said containers from a support, using said first hanging means, and to hang a second one of said containers from said first container by engaging said first hanging means of said second container with said second hanging means of said first container.

6. A hat storage container as in claim 1, the main body portion of a hat, which said container is dimensioned to receive, having a domed shape in transverse section when set up for use, said main body chamber having an elongated domed shaped corresponding generally to, and elongated longitudinally from, the domed shape of the main body portion of the hat.

7. A container for receiving bill hats, said container comprising outer walls defining a container body portion and a container bill, and an enclosed space therein, said enclosed space including a main body chamber and a bill-shaped chamber, said chamber having an external configuration generally corresponding to an elongated hat of a transversely domed shape and having a bill on one end thereof, said container being dimensioned to receive a plurality of bill hats in collapsed front-to-rear array in said main body chamber, and being dimensioned to receive the bills of the leading hats of the plurality of hats in a trailing shingled array in said bill-shaped chamber, wherein the leading edge of the bill of a trailing hat is positioned below and somewhat to the rear of the leading edge of the bill of the next forwardly disposed hat.

8. A container as in claim 7, each of the bill hats having a main body portion having a length and a width, the length "L" of said main body chamber exceeding the corresponding length of the main body portion of a collapsed corresponding one of the bill hats by more than the width "W" of said main body chamber exceeds the width of the corresponding collapsed hat.

9. A container as in claim 8, including a first hanging means on said bill and a second hanging means on said body portion, opposite said bill, said first and second hanging means being adapted to hang a first one of said containers from a support, using said first hanging means, and to hang a second one of said containers from said first container by engaging said first hanging means of said second container with said second hanging means of said first container.

10. A container as in claim 7 including hanging means as a portion of said container at the rear thereof remote from said bill, thereby to permit hanging of said container with the bill chamber lowermost.

11. A container as in claim 7, including a first hanging means on said bill and a second hanging means on said body portion, opposite said bill, said first and second hanging means being adapted to hang a first one of said containers from a support, using said first hanging means, and to hang a second one of said containers from said first container by engaging said first hanging means of said second container with said second hanging means of said first container.

12. A hat storage container as in claim 7 wherein said body portion and said bill, of said container, generally conform to the same shape, said body portion being elongated, as the corresponding body portion and bill elements on the hats which said container is dimensioned to receive, whereby said container comprises a transversely domed body portion, and said bill on only one end of said body portion.

13. A container as in claim 7 wherein said collapsed front-to-rear array of hats define respective convex forward surfaces of said hats and concave rearward surfaces of said hats within which the said convex forward surfaces are serially received, thereby to facilitate positioning of said shingled bills in said bill-shaped chamber.

14. A container as in claim 13, including a first hanging means on said bill and a second hanging means on said body portion, opposite said bill, said first and second hanging means being adapted to hang a first one of said containers from a support, using said first hanging means, and to hang a second one of said containers from said first container by engaging said first hanging means of said second container with said second hanging means of said first container.

* * * * *